United States Patent [19]

Andrews

[11] 4,219,989

[45] Sep. 2, 1980

[54] BAGGING APPARATUS

[75] Inventor: H. David Andrews, College Park, Ga.

[73] Assignee: Star Packaging Corporation, College Park, Ga.

[21] Appl. No.: 60,939

[22] Filed: Jul. 26, 1979

[51] Int. Cl.[3] ..... B65B 43/34

[52] U.S. Cl. ..... 53/572; 53/257; 53/260; 53/261; 53/385

[58] Field of Search ..... 53/572, 257, 260, 261, 53/385

[56] References Cited

U.S. PATENT DOCUMENTS

| | | | |
|---|---|---|---|
| 3,145,517 | 8/1964 | Saumsiegle | 53/572 |
| 3,490,195 | 1/1970 | Abramson | 53/572 X |

*Primary Examiner*—Travis S. McGehee

*Attorney, Agent, or Firm*—David H. Semmes

[57] ABSTRACT

A stretch bagging apparatus of the type having a reciprocable table top, including a pair of transversely extensible horns which are advanced axially into an open ended bag supported upon a bag elevator. After the horns advance into the bag, they are transversely extended so as to stretch the bag sides during filling of the bag. After the bag is filled with a chicken or the like, a carriage supporting the table top is axially retracted. The present apparatus is characterized principally by its provision for a longitudinally reciprocable table top which supports and axially advances both the article being bagged and the transversely extensible horns. The bag elevator includes a pivoted hocking plate valving mechanism which enables the operator to override the packaging system by pushing the filled bag against the hocking plate.

7 Claims, 10 Drawing Figures

BAG OPENING MODE

BAG RELEASE MODE

BAGGING APPARATUS

BACKGROUND OF THE INVENTION (1) Field of the Invention

Stretch bagging, particularly an apparatus for stretching open conventional plastic bags, so as to admit a chicken carcass or the like during the packaging operation. Conventionaly, such apparatus includes one or more vertically actuable horns upon which the stretch bag may be placed prior to filling. The horn is then actuated vertically to stretch open the bag, as the bag is filled with a chicken carcass, vegetable produce or the like. The filled bag is then removed from the horn and closed prior to heat shrinking, freezing or other treatment.

(2) The Prior Art

Being submitted separately under the provisions of 37 C.F.R. 1.97.

SUMMARY OF THE INVENTION

According to the present invention, a plurality of open ended stretch bags are mounted upon a bag elevator, which is supported at one end of a longitudinally reciprocable table top. The table top, also, supports a pair of transversley reciprocable bag opening horns. As the table top is advanced toward the bag elevator, an air jet is activated to open the top most bag, while the horns are axially advanced into the interior of the bag. A cam mechanism positioned between the transversely extensible horns is then activated to transversely extend the horns, so as to stretch the bag sides for filling with a chicken carcass, vegetable produce or the like. As the bag is filled, it is pushed against a pivoted hocking plate supported on the elevator, so as to retract longitudinally both the table top and the horns from the filled package. The top, filled bag may then be torn from a conventional bag holding wicket and removed for heat shrinking, freezing closure or other packaging treatment. The cycle may then be repeated.

DESCRIPTION OF THE PREFERRED EMBODIMENTS

Figure 1:
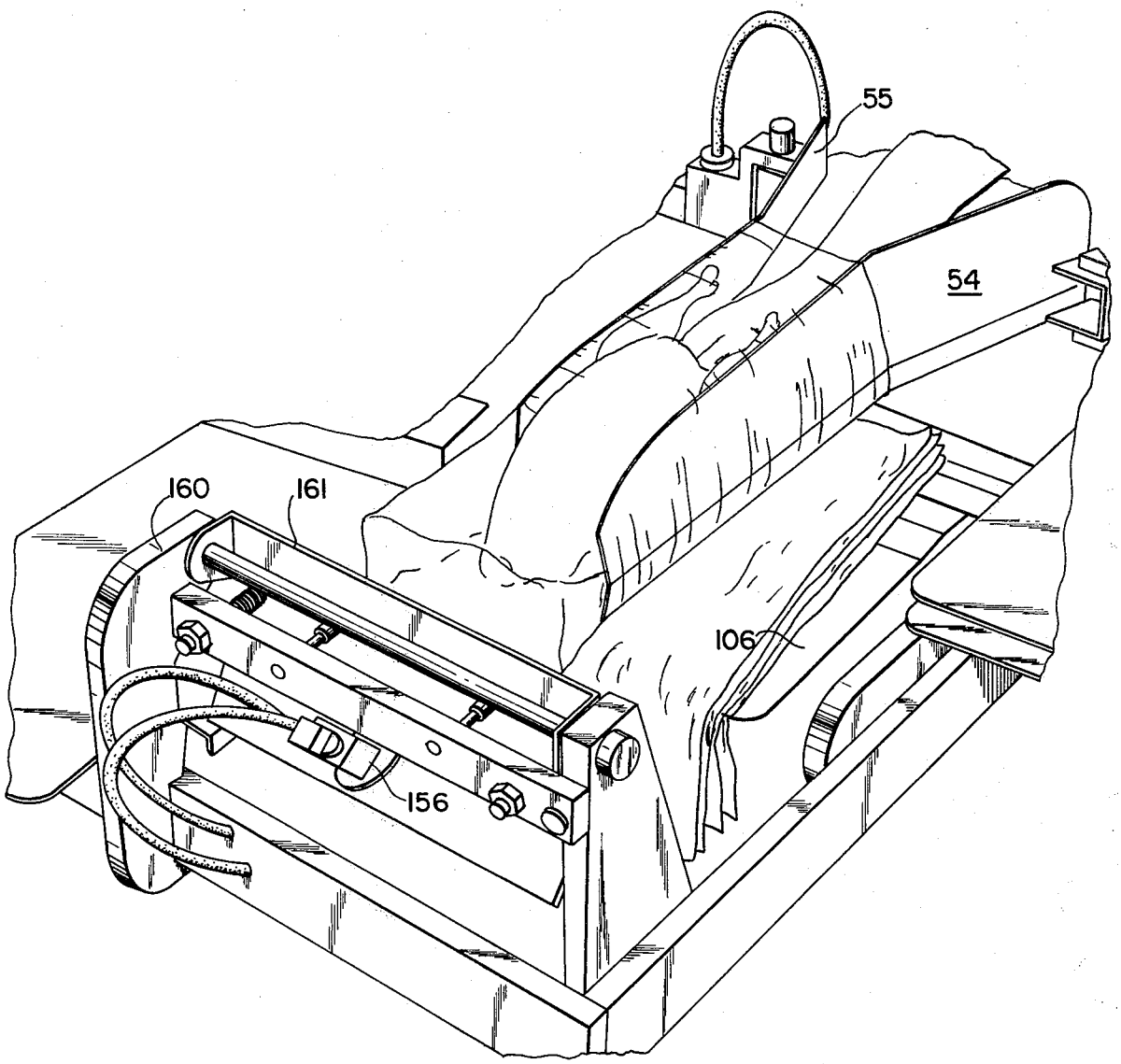
FIG. 1 is a fragmentary perspective, showing the transversely extensible horns stretching the bag sides apart, as a chicken carcass is inserted into the top open-ended bag prior to abutment with the pivoted hocking plate.
Figure 2:
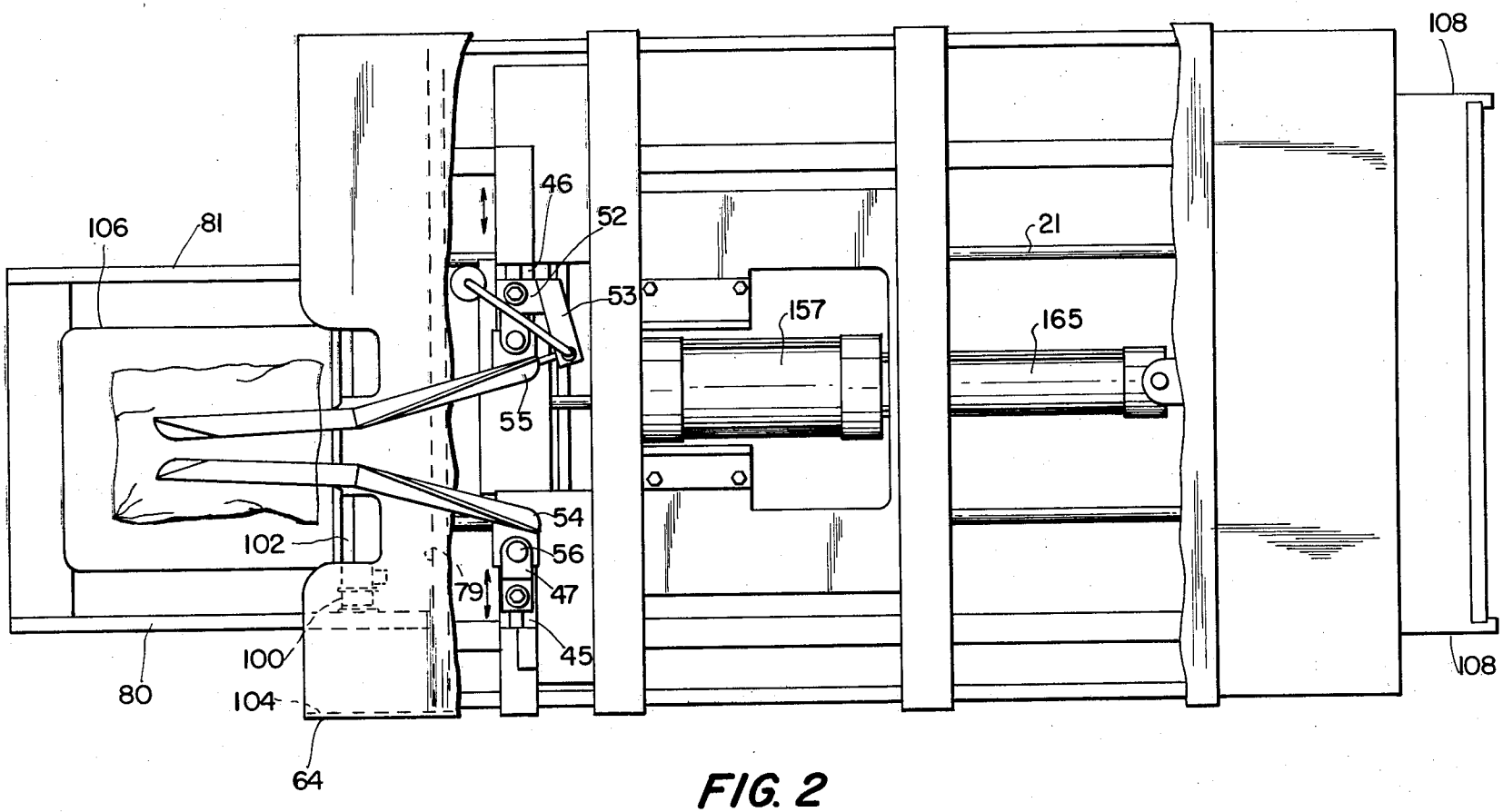
FIG. 2 is a top plan, partially fragmentary, showing the transversely extensible horns upon axial advancement into a top bag.

In FIGS. 1 and 2 there are illustrated the bag opening horns 54 and 55. Particularly, in FIG. 1, the operator's hand (shown in fragment) is shown inserting a chicken carcass into a top open-ended bag, supported upon a bag elevator. As the bag is filled, the operator advances bag and carcass against hocking plate 161, pivoted between upright sides 160, so as to activate air terminal valve 156. Table top 64 and horns 54, 55 are then retracted axially away from the package, which is then removed by the operator for shrinking, freezing or other final packaging operation.

In FIG. 2, which is a top plan, table top 64 is shown fragmentarily, while the bag elevator is illustrated as having rear guide vertical members 100, rear slide top cross member 102, as well as cam track side plates 80 and 81. The bag supply support plate 106 is urged upwardly by the lift cylinder 87 (illustrated in FIG. 3). The elevator assembly may also include a back mounting plate 79.

Figure 6:
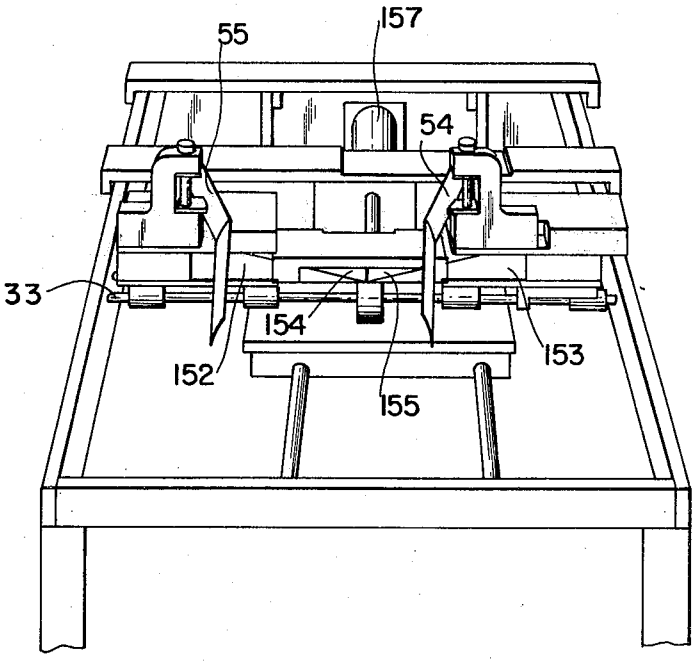
FIG. 6 is a fragmentary perspective showing the bag opening horns in the state of transverse extension by means of the cam mechanism.
Figure 5:
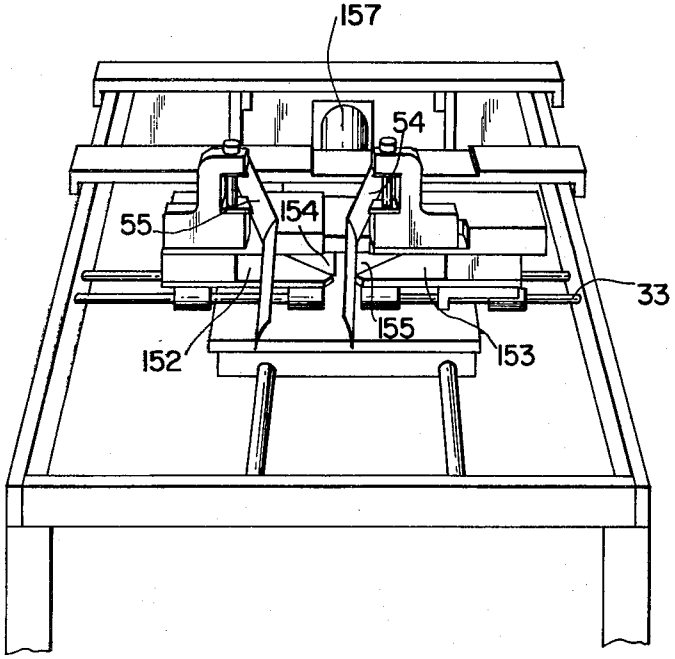
FIG. 5 is a fragmentary perspective showing the bag opening horns prior to their transverse extension.

The bag opening horns 54, 55 are mounted by means of identical horn retainer pins 56 which extend into horn opening adjusting holders 47, each in turn being mounted upon T-slot plates 45 and 46, the plates being mounted, as illustrated in FIGS. 5 and 6 upon transversely extending rods 33 or the like. Horns 54, 55 are extended transversely by means of longitudinal reciprocation of the triangular cams 154, 155 contacting the complementary plates 152, 153, as cam 157 cylinder is actuated.

Horn 55 and/or 54 may include a moving air jet spacer arm 52, having a movable air jet mounting block 53. The frame assembly which supports the reciprocable table top 64, may include side plates 108.

Figure 3:
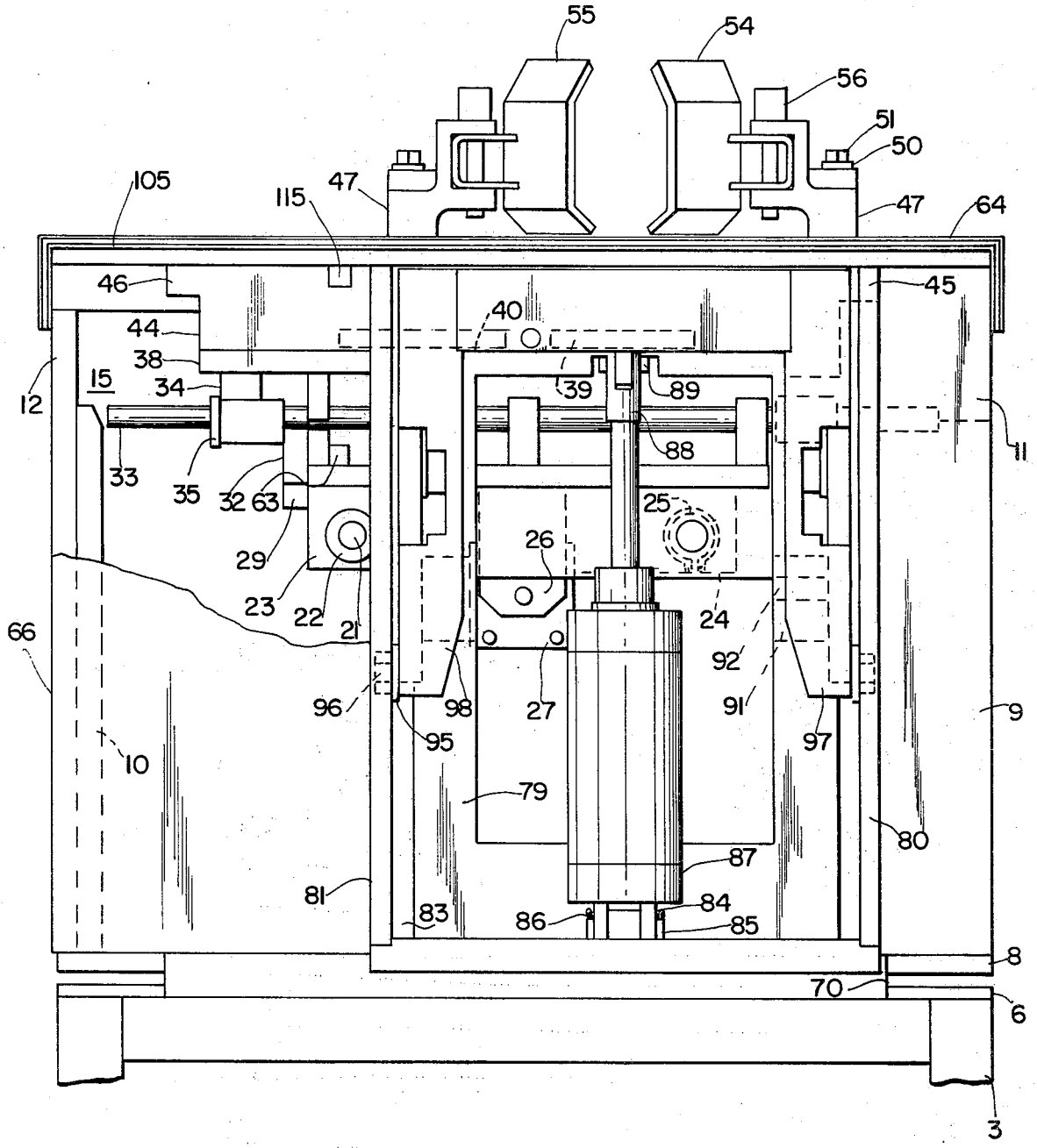
FIG. 3 is a front end elevation, partially fragmentary, showing the bag elevator cylinder pushing the bag elevator vertically upwardly and in axial alignment with the bag opening horns.

In FIG. 3 there is illustrated the bag elevator lift cylinder 87, axially aligned with the bag opening horns 54, 55. The longitudinally reciprocable table top 64 is shown superposed with respect to initial opening jet cover 105 and table top support gusset 115. The apparatus frame may include corner posts 9 and, vertical members 11 and 12 superposed with respect to corner attaching plates 8 and 6 and leg assembly 3. Crossslide rod 33 is shown as supporting bushing 35, bushing mounting block 34 and the individual T-slot plates 45 and 46 with respect to cam plate base 38 and transverse bars 39 and 40. The table top bushing mounting block 24 is shown supporting longitudinal carriage 21 in bushing snaprings 25 for the table reciprocating or advancing cylinder 165.

In the elevator assembly cylinder 87 is mounted upon lower pivot pin 85 secured by cotter pins 84 and 86. The elevator assembly back mounting plate 71 is shown with respect to front slide vertical member 98. The elevator lift arm pivot mounting bracket 91 is illustrated with respect to lift arm pivot pin 92 and front slide vertical members 97, 98. Lift arm slide rollers 95 are secured to the vertical members by means of slide roller shaft 96. The lift cylinder 87 shaft includes a lift cylinder upper clevis 88 which engages upper pivot pin 89. This mechanism is illustrated in phantom at the lefthand side of FIG. 7.

Figure 4:
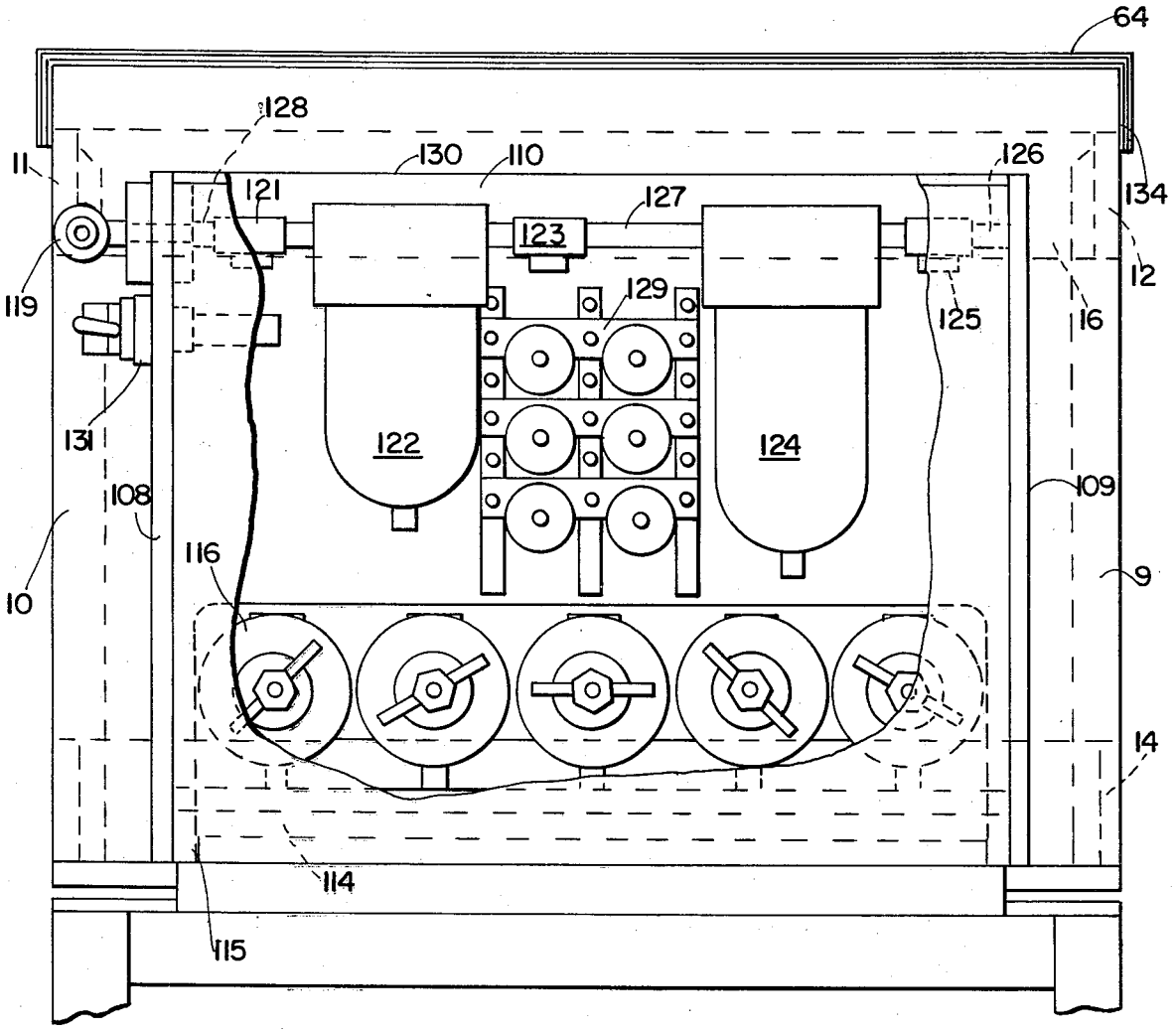
FIG. 4 is a fragmentary rear end elevation, showing the logic control system and air pressurized valving mechanism.

In FIG. 4, there are illustrated side plates 108, 109 and top plate 110 supported with the frame. An air pressure manifold 114 is shown in phantom, as secured in support gusset 115, and connectable with a plurality of pressure regulators 116. An air pressure On-Off selector switch 131 may be provided for activating the entire system. Air support elbow 119 supports air control system crossnipple 128 and air supply tube 121. An access door 130 may be provided between side plates 108 and 109. The primary air filter 122 is supported between air supply tee 121, and adjacent air supply tee 123. A 0.01 micron coalescing air filter 124 is shown adjacent bag opening jet air supply tee 125. A filter system support plug 126 may also be employed. A logic assembly module base, generally illustrated at 129 may be provided for activating the various reciprocating cylinders and pressurized air valves.

Figure 7:
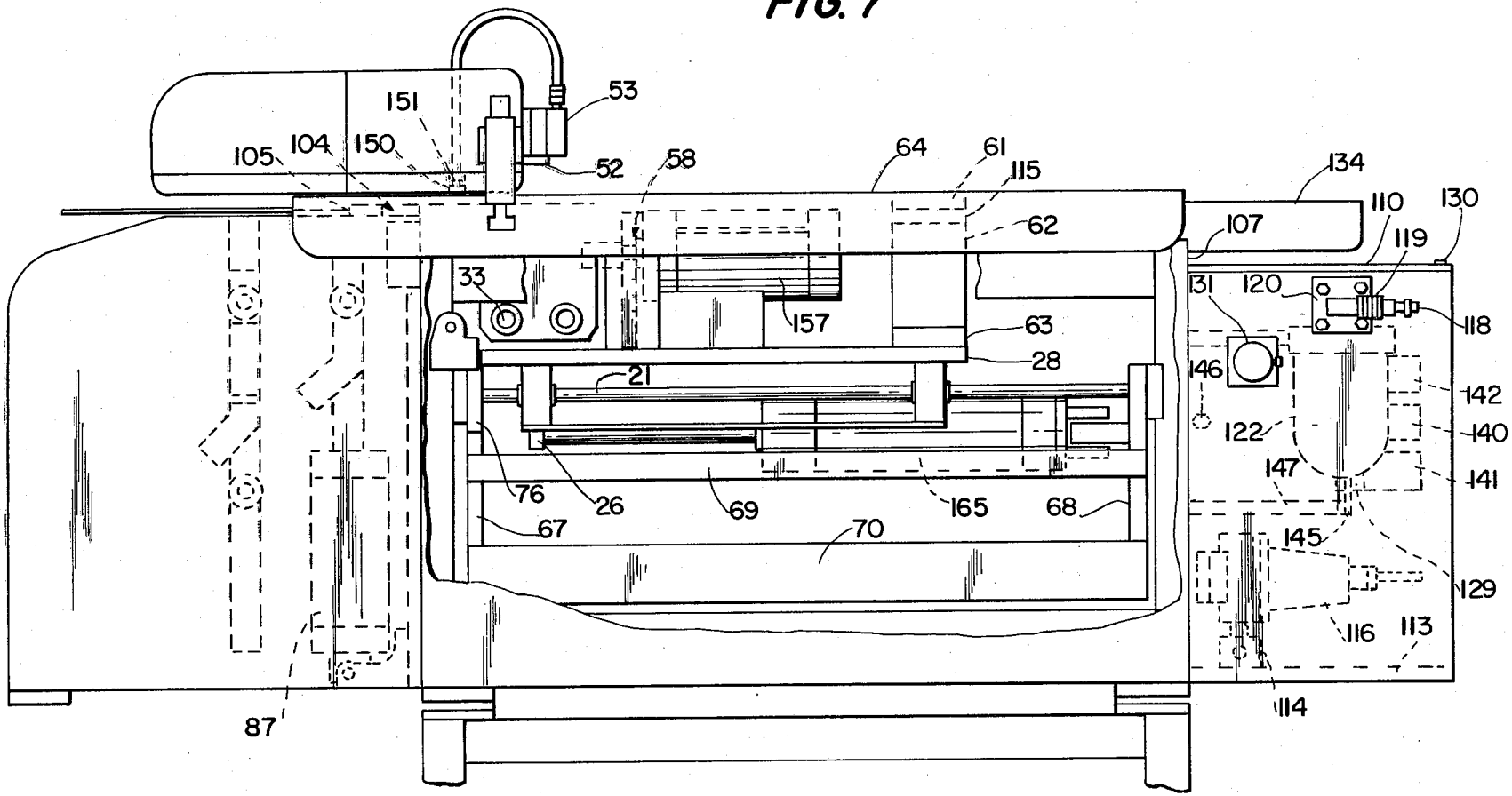
FIG. 7 is a side elevation, partially in section, showing at the righthand end the logic system and air pressurized valving mechanism and in mid-section the advance cylinder which reciprocates the table top, as well as the cam cylinder which activates the bag opening horns.
Figure 8:
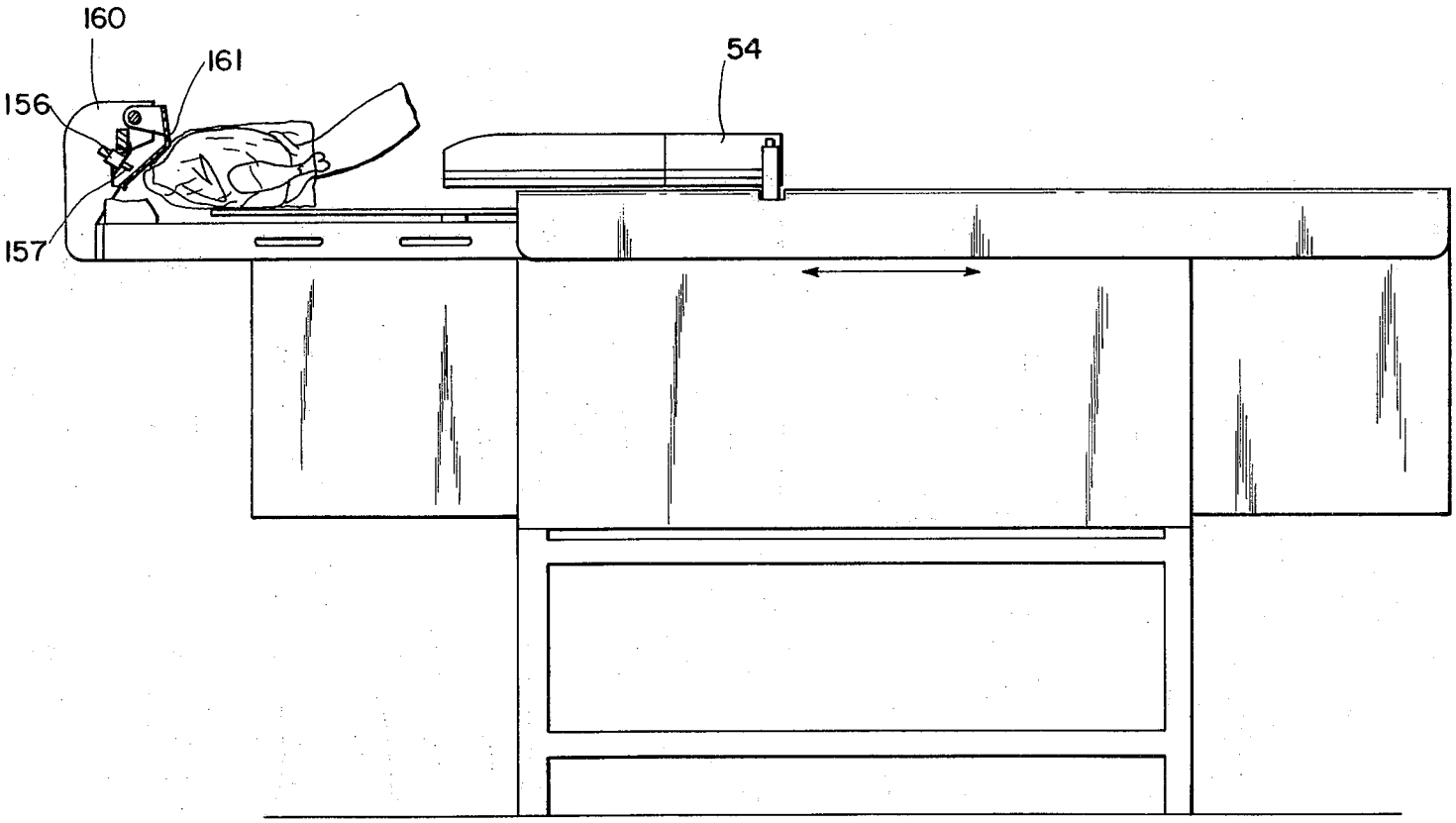
FIG. 8 is a front elevation, partially in section, showing pivoting of the hocking plate and adjacent valving mechanism, as the filled bag is pushed by the operator against the hocking plate.
Figure 9:
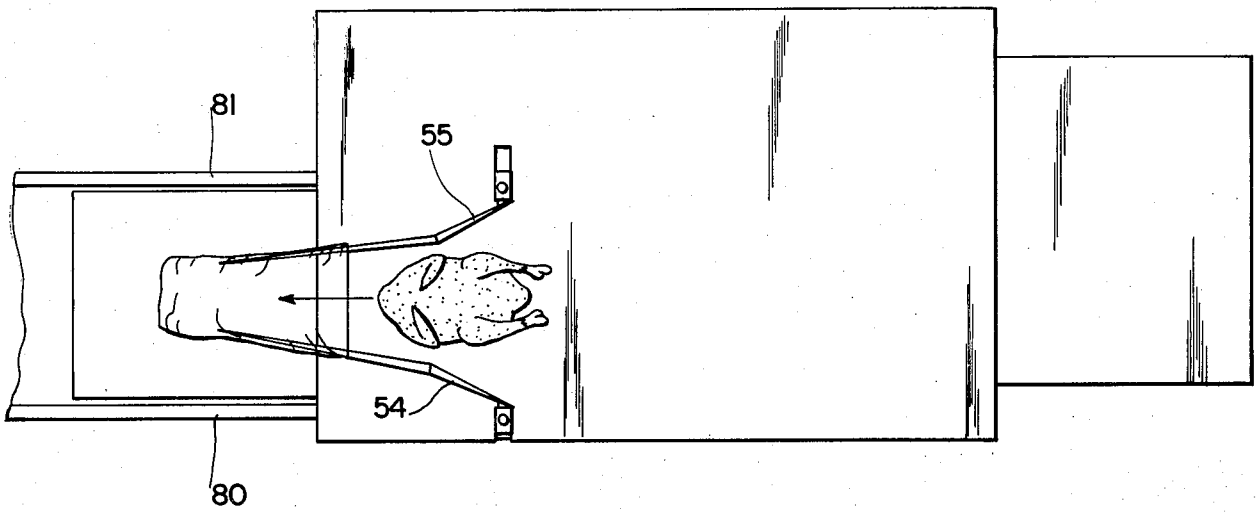
FIG. 9 is a top plan, partially fragmentary, showing advancement of the chicken carcass into a top bag, having its sides stretched apart by the bag opening horns.
Figure 10:
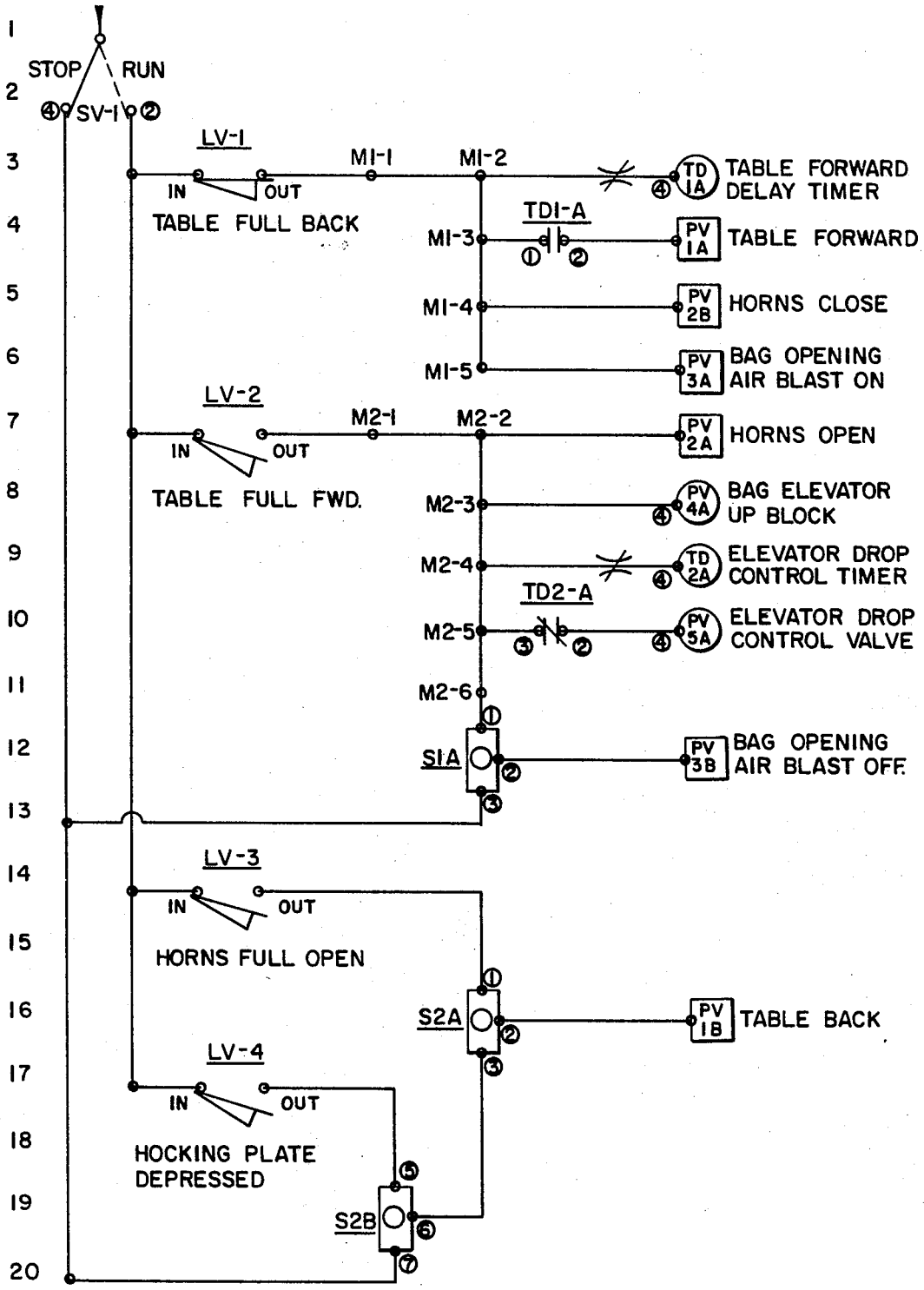
FIG. 10 is a circuit "ladder" diagraming a suggested air logic control system for the present apparatus.

At the right hand side of FIG. 7 the air control assembly is further illustrated as including a control panel backplate 107, supply line mounting plate 120 and air supply conduit 118. The logic elements 140 and 142 are shown supported above logic valve 141 and logic assembly standoff 142, secured by logic base strap 145. Functional control pressure regulator manifold 114, secured by means of bottom gusset 113. A logic manifold 146 is shown, in phantom.

Also illustrated in FIG. 7, is rear end table top run out protective cover 134 which is stationary. In the mid-section of FIG. 7 table top 64 is shown supported above table top support cross member 61, top gusset 115 and support upright 62. A lower support gussett 63 may also by employed to secure the entire mechanism adjacent carriage assembly base plate 28. A limit valve mounting bracket 76 may also be employed together with valve mounting bracket 67 and mounting bar 69, as well as power valve mounting bracket 68 and mounting bar 70. Cam slide driving cylinder front mounting plate 58 is shown adjacent the cylinder 157.

Initial opening jet orifice block 104 is shown positioned adjacent initial open jet cover 105. Air jet spacer arm 52 is shown adjacent moving air jet mounting block 53, the pressurized air for bag opening was diverted through air jet quick disconnect valve 150 and coupler 151. Initial opening jet orifice block 104 and initial opening jet cover 105 are illustrated in phantom.

OPERATING THE STRETCH BAGGER:

For the purposes of poultry packaging, it is assumed that a source of pressurized air is provided for maintaining a constant 80 P.S.I. air supply to the air supply tube 121.

1. The operator takes a wicket load of bags, removes the two (2) rubber grommets retaining the bags on a conventional wicket (not illustrated) and inserts the two legs of the wicket into the proper holes in the Elevator Lift Slide and straightens the bags on Bag Support Plate 106.
2. The operator places the "Run/Stop" Toggle Selector Valve in the "Stop" position and then slides the "Main Air Supply Sleeve Valve" into the "Open" or "Full Forward" position. This supplies air to the entire machine causing the following things to occur:
   a. The bag elevator rises to its uppermost position, locking the cross-bar of the wicket against the bag opening air blast plate.
   b. The carriage moves to the full back position.
   c. The bag opening air blast is turned off.

When the bag elevator is fully up, the operator moves the "Run/Stop" toggle selector valve to the "Run" position. The following actions occur:

a. The bag opening air blast is turned on, blowing open the top bag on the elevator.
b. The bag opening horns close.
c. After an adjustable delay, the table top carriage moves forward.

This was accomplished because when the Run/Off selector valve was moved to the "Run" position, the automatic air circuit was then pressurized to the supply port on each of the Limit Valves in the circuit. The rear most limit valve (LV-1, not illustrated), which is "normally closed" is held open by the Limit Valve Activator for air to flow through it to pressurize the pilot port on the Horns Open and Close Power Valve, which causes the Horns 54, 55 to close, if not already closed, as is the case on initial start-up. It also supplies air to the Time Delay Valve (TD-1, not illustrated) which controls the signal to make the Carriage Movement Power Valve to shift to move the the Horns into the opened top bag. This occurs after the time set on the timer allows the control valve portion of the timer to allow air to pass to the pilot port on the Carriage Movement Power Valve, which controls forward motion on the carriage.

The carriage moves full forward causing the Limit Valve Activator Bar to depress the Full Forward Limit Valve (LV-2) and releasing Limit Valve (LV-1).

The following actions occur:

a. LV-2 is now allowing air to flow to the opposite side of the Bag Opening Power Valve pilot port, thus shifting the spool to the "Off" position stopping all air flow to the Bag Opening Jets and Blast Nozzle.
b. It also pressurizes the pilot port on the Horns "Open/Close" Power Valve to shift that valve to the horns open (or Stretch) position.
c. It further sends a signal to the Elevator "Up" air supply line Control Valve shutting off the air supply to the Elevator Lift Cylinder, and to a Time Delay Valve (TD-2) which controls the amount of air to be bled out of the Elevator Lift Cylinder to control the amount of "Drop" which will occur before the timed valve closes, stopping the air from further bleeding out of the Elevator Lift Cylinder.

This Elevator Drop is a feature used to release the Bag Wicket Cross-Bar from the Bag Opening Jet Plate, a controlled amount, to prevent locking the portion of each individual bag from being torn off between the wicket holes in each bag and leaving a slug of plastic film which prevents proper opening of the next bag as well as the possibility of introducing those slugs into bags further down in the stack.

3. The Machine is now ready with the bag to be filled stretched open, the air blast turned off and the Elevator Dropped to its proper position. The operator procures the Product to be loaded into the bag, usually a "Whole Fryer", by its two legs, places it on its back with the wings between the "lead-in" portion of the two Horn blades which have entered and are holding the bag in its stretched open position proceeds to push the chicken into the bag until the chicken and Bag press against the swinging "Hocking Plate". When the chicken first presses against the swinging "Hocking Plate", the pivoting action of the plate depresses Limit Valve (LV-4) which sends a signal to the pilot port on the Carriage Movement Power Valve which shifts its spool to cause the carriage to move back, pulling the horns out of the loaded bag as the operator finishes "Hocking" the chicken. Backward movement of the carriage causes the Limit Valve Activator Bar to release Limit Valve (LV-2) which releases the air pressure holding the "Elevator Up" Blocking Valve, allowing it to open and let air return to the Elevator Lift Cylinder to the "Full Up" position and to reset the Elevator Lift Cylinder Bleed Valve Time Delay Valve.

The operator now lifts the loaded bird out of the "Hocking Station" and either ties and trims the bag at an attachment mounted on the machine or places it on a conveyor or other device of the Processors choosing and the bag is "tied and trimmed" down stream from the loader.

4. The return of the carriage automatically causes the Limit Valve Activator Bar to first trip or open LV-2 which starts the Bag Opening Air flowing again and when fully back trips or opens LV-1 to start a new cycle.

In the event of a "Hocking Station " is not used or the Horns fail to enter and open the bag or a defective bag tears and allows the Horns to move fully open, an activator on the Horn Opening Slide, trips or opens a Limit Valve (LV-4) which sends a signal to the Carriage Movement Power Valve causing it to shift its spool to make the carriage to move back. Both LV-4 and or LV-5 cause the same action.

Cylinder speed for both the Carriage Movement and the Horns Open and Closing Movement are controlled by individual adjustable needle valves in the exhaust ports of their respective power valves.

To insure clean, oil free air to open the bags, a Primary Air Filter 122 is used first in the line of the incoming air and then proceeds down stream through a "Oil Removing Filter" 124 which removes all of the oil vapors which might be present in the air.

Moving the Main Air Sleeve Valve to its rearmost position releases all air pressure in the machine and also allows the bag Elevator to drop to its lowest position. The dropping of the Elevator Slide causes the top portion of the Elevator Slide to move outward from the vertical position to facilitate loading of a wicket of bags.

The Horn Holder Blocks 47 are held in place by a tee-nut so that each horn assembly is individually and infinitely adjustable for proper position to enter and open various sized bags.

Air pressure to the Control Circuit, Carriage Movement Power Valve, Horn Stretch Power Valve, Elevator Lift Cylinder and the Bag Opening Air Power Valve are all individually adjustable by individual regulators or Needle Valves.

The Horns and Table Top and the Flexible Air Line to the Air Blast Nozzle are easily removable for easy access to clean the machine inside and out to meet U.S.-D.A. requirements.

The "Hocking Station" is adjustable to allow for different size products if required. Also, there is a provision to adjust the height of the table top surface in relation to the floor.

I claim:

1. A stretch bagging apparatus comprising:

A. A table support for an article being packaged within a stretch bag, including an upright frame and a table top longitudinally reciprocable upon said frame;

B. A stretch bag elevator, affixed at a bagging end of said frame so as to support a plurality of open ended stretch bags in superposed relationship with a top open ended bag aligned with said longitudinally reciprocable table top;

C. A pair of transversely reciprocable bag opening horns affixed to said longitudinally reciprocable top in axial alignment with said bag elevator and including a cam mechanism being first actuated to open transversely said horns so as to stretch the bag during the bagging mode, as said horn ends axially advance into the top bag, and said cam mechanism being second actuated to close transversely said horns sequentially of bagging as said horns and table top are reciprocated away from said bag elevator;

D. A pressurized air actuation system including:

i. a source of pressurized air;

ii. a bag elevator lift cylinder positioned beneath said elevator;

iii. a table top reciprocating cylinder supported in said frame and engageable with said table top;

iv. a cam opening cylinder, supported in said table top and engageable with said bag opening horns cam mechanism, and v. a bag opening jet tube with its open end supported adjacent one or more of said bag opening horns, such that pressurized air is diverted into said open ended bag during the bag opening operation.

2. A bagging apparatus as in claim 1, said pressurized air actuation system further including a timed release logic system and valving mechanism actuable to sequentially:

i. lift said bag elevator, raising vertically said open ended bags with respect to said table top;

ii. open via air jet a top most stretch bag;

iii. return said table top towards said bag elevator;

iv. transversely open said bag opening horns;

v. lower said bag elevator;

vi. retract said table top away from said bag elevator; and vii. transversely close said bag opening horns.

3. A bagging apparatus as in claim 2, further including a hocking plate, pivotably mounted at an end of said bag elevator away from the top bag open end and having a closing valve contacted by said hocking plate during the bagging, as an article being bagged and said bag are pushed against said hocking plate.

4. A bagging apparatus as in claim 3, said bag opening horns being mounted upon transversely extensible plates, slidably supported upon a pair of transverse bars mounted within said table top and said cam mechanism being longitudinally reciprocable between said transversely extensible plates upon actuation of said cam opening cylinder.

5. A bagging apparatus as in claim 4, said horns being individually transversely adjustable with respect to each other.

6. A bagging apparatus as in claim 5, said lonitudinally reciprocable table top being mounted upon a pair of longitudinally extending rods supported with said frame.

7. A bagging apparatus as in claim 6, said valving mechanism, including an air jet affixed to one or more of said bag opening horns and programmed to blow open the top stretch bag, as said horns are longitudinally advanced with said table top towards said bag elevator.

* * * * *